United States Patent [19]

Child et al.

[11] 4,395,940

[45] Aug. 2, 1983

[54] APPLIANCE FOR MAKING AN AERATED BEVERAGE AND A CAP FOR A BOTTLE USED THEREIN

[75] Inventors: Robert P. Child, Cosham; Barry G. Charles, Rowlands Castle, both of England

[73] Assignee: Thorn Cascade Company Limited, London, England

[21] Appl. No.: 262,636

[22] Filed: May 11, 1981

[30] Foreign Application Priority Data

May 13, 1980 [GB] United Kingdom ..... 8015791

[51] Int. Cl.[3] ..... B01F 3/04

[52] U.S. Cl. ..... 99/323.1; 215/312; 222/402.25; 261/DIG. 7

[58] Field of Search ..... 99/323.1, 323.2, 285; 261/121 R, DIG. 7, 122, 123; 222/402.25; 215/311, 312

[56] References Cited

U.S. PATENT DOCUMENTS

| | | | |
|---|---|---|---|
| 2,185,290 | 1/1940 | Bravo | 215/312 |
| 3,221,946 | 12/1965 | Riley | 222/402.25 |
| 3,223,173 | 12/1965 | Paul | 222/402.25 |
| 3,953,550 | 4/1976 | Gilbey | 261/DIG. 7 |
| 4,251,473 | 2/1981 | Gilbey | 261/DIG. 7 |
| 4,298,551 | 11/1981 | Adolfsson | 261/121 R |

*Primary Examiner*—Robert W. Jenkins

*Attorney, Agent, or Firm*—Fleit, Jacobson & Cohn

[57] ABSTRACT

The appliance includes a casing 10 in which is mounted a connection 13 for a container 12 of pressurized liquid carbon dioxide. A bottle 80 of water is provided with a special cap 82 having a dip tube therein which extends into the water. The cap has a non-return valve 89 to 92 therein. The bottle is partly filled with water, the cap screwed into place and a nozzle on the appliance is caused to introduce carbon dioxide directly into the bottle with the cap thereon.

6 Claims, 3 Drawing Figures

APPLIANCE FOR MAKING AN AERATED BEVERAGE AND A CAP FOR A BOTTLE USED THEREIN

DESCRIPTION

The present invention relates to an appliance for making an aerated beverage.

Conventionally, appliances of this type can consist of a casing, in which is enclosed or mounted a container of pressurized liquid carbon dioxide. Connected to this container, by a manually operated valve, is an elongate nozzle which is either permanently angled downwardly and forwardly, or is pivotable between such a position and a vertical position. A bottle, which is partly filled with water, is moved upwardly relative to the nozzle, so that the nozzle is immersed in the water, with the nozzle in the inclined position. The bottle is held in position with its neck against a stopper at the top of the nozzle, usually after pivoting the nozzle to a vertical position. The equipment also usually includes a shatterproof housing which surrounds the bottle, when it is in position around the nozzle.

The manually operated valve is actuated a few times and a carbon dioxide gas is thus introduced into the water. A safety valve is provided which releases any excess pressure which may occur in the bottle. The bottle is then removed from the appliance, and its contents are either used in this form, as soda water, or a concentrate flavouring syrup is added to obtain an aerated beverage, such as lemonade, tonic water, cola etc.

Such a construction of appliance requires a fairly large number of manipulative operations.

It is now proposed, according to the present invention, to provide a cap for a bottle to be used in an appliance for making an aerated beverage, said cap comprising a body securable to the neck of a bottle, a dip tube mounted on the cap body to extend into water contained in the bottle when the cap is secured on the neck, a passage in the cap communicating with the dip tube and with the exterior, enabling carbon dioxide to be introduced under pressure through the dip tube into the water in the bottle, and a non-return valve mounted in the passage to prevent water or gas returning to the exterior via said passage.

All that is necessary, with such a construction, is partly to fill the bottle, to screw the cap according to the invention onto the bottle, to introduce the bottle under an adaptor which is provided with means to seal with the cap. The arrangement is such that one can introduce the concentrate into the water before the aeration step takes place. This greatly simplifies the number of manipulative steps that are necessary. The non-return valve prevents the concentrate from frothing up. If a suitable time is left after the aeration step, then there is no tendency for the prepared beverage to foam up when the cap is removed.

According to a further aspect of the invention there is provided an appliance for making an aerated beverage, said appliance comprising a casing, a connection carried by said casing for mounting a container of pressurized liquid carbon dioxide, a bottle to be filled with water, a shatterproof housing for the bottle of water and carried by said casing, a nozzle communicating with said connection and extending downwardly within said housing, means for supporting the bottle in said housing whereby the nozzle can communicate with the interior of the bottle, a manually operable valve allowing carbon dioxide to flow from said container mounted on said connection to said nozzle, and thus into the water in the bottle, a cap on said bottle, including a body securable to the neck of the bottle, a dip tube mounted on said cap body to extend into water contained in said bottle when the cap is secured on the neck, a passage in the cap communicating with the dip tube and with the exterior, enabling carbon dioxide to be introduced under pressure through the dip tube into the water in the bottle, and a non-return valve mounted in the passage to prevent water or gas returning to the exterior via said passage.

The bottle is preferably mountable in a shatterproof housing. The bottle can be raised against the adaptor, or, alternatively, the adaptor can be lowered against the bottle. With the construction above described, it is also contemplated that the bottle could be mounted in any orientation, because there is no problem of spillage, at any time.

The above arrangement works perfectly satisfactorily if the pressure of the incoming gas is kept relatively low, by providing a pressure reducer or an overpressure valve in the feed path of the gas to the nozzle.

However, it is also contemplated that the cap should comprise a housing, a valve seat at the upper end of said housing, a valve member axially movable in the housing, a spring urging the valve member resiliently against the valve seat, and at least one bleed hole in the housing to provide communication between the interior of the housing above the valve member, when it is unseated from the valve seat, and the space above the water in the bottle.

When the nozzle is introduced it will unseat the ball, to allow the carbon dioxide to pass down a dip tube into the water in the bottle. Gas pressure above the water will be sensed via the bleed hole or holes and an excess pressure will be released by the overpressure valve.

It is also contemplated that the cap could be provided with a double valve arrangement, one allowing the inward flow of gas under pressure, as before, and the other being connected to the space above the water in the bottle and being in communication with an overpressure valve in the appliance. Such a cap may further comprise a top portion, an aperture in said top portion, a piston mounted for limited vertical reciprocatory motion in said aperture, a clearance being formed between the piston and the aperture walls, means to restrain downward movement of the piston, an upwardly facing shoulder on said piston, a downwardly facing lower surface formed on said top portion of the cap and engageable by said upwardly facing shoulder, a passage in said piston, said dip tube being engaged in said passage, a valve seat at the upper end of said passage, a valve member axially movable in the passage and a spring urging the valve member resiliently against the valve seat.

With such a cap mounted on the bottle, the latter is placed in the appliance and engaged with the upper mouth of the bore in communication with the nozzle to unseat the annular shoulder and at the same time an annular gasket surrounding the nozzle engages the upper surface of the cap. Thus the space above the water is placed in communication with the interior of the annular gasket which in turn is connected to an overpressure valve in the appliance. When gas is caused to flow through the nozzle, the gas pressure will unseat the non-return valve so that the gas can flow to the dip tube to carbonate the water. Any excess pressure can pass via the clearance between the piston and aperture to the overpressure valve.

In order that the present invention may more readily be understood, the following description is given, merely by way of example, reference being made to the accompanying drawings in which.

Figure 1:
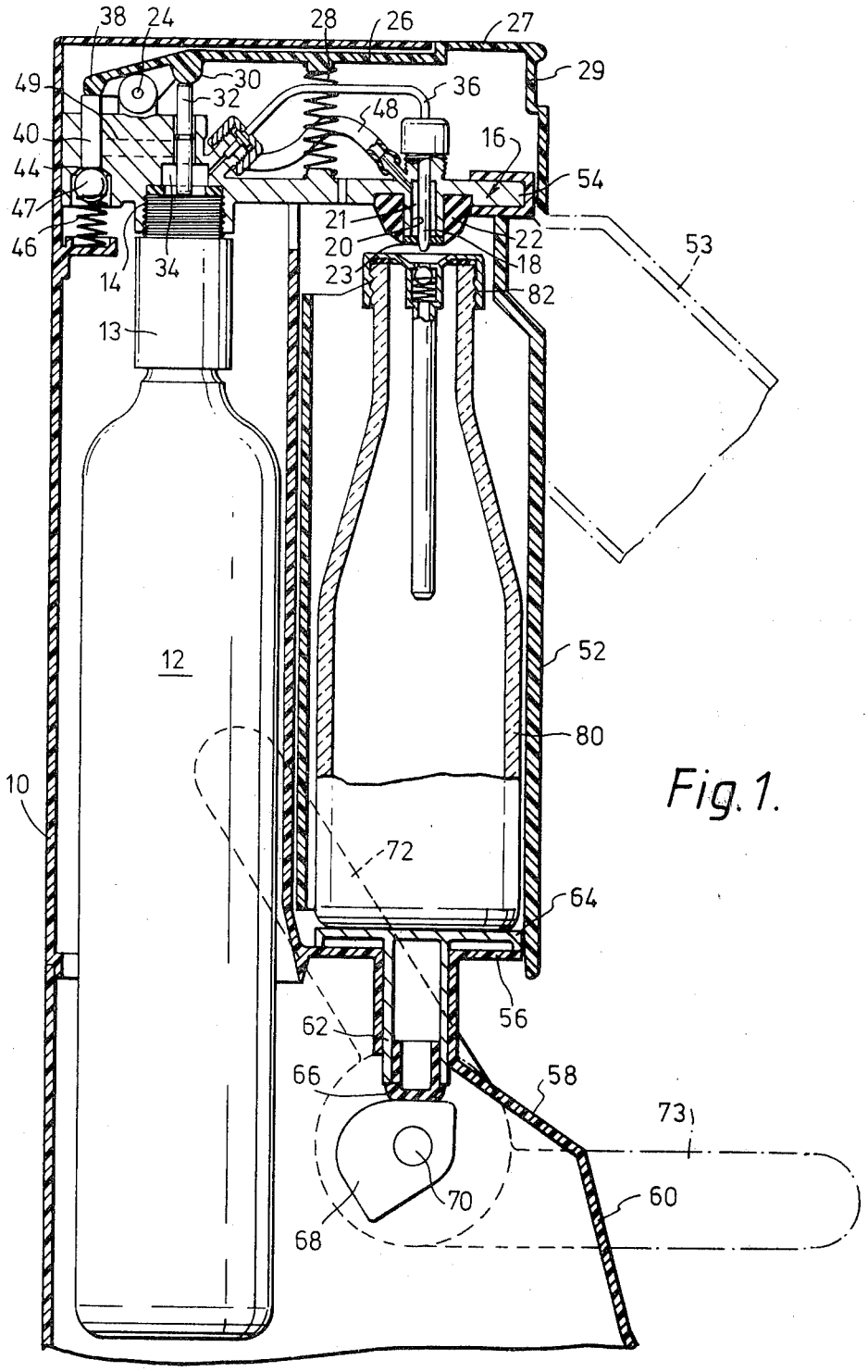
FIG. 1 is a cross-section through one embodiment of appliance according to the present invention.

The appliance shown in FIG. 1 includes a main casing 10 in which is positioned a carbon dioxide container 12, this being threaded with a fitting 14 forming part of an upper casing member 16. Secured to a portion 54 adjacent the front (i.e. the right as seen in FIG. 1) of member 16, is a downwardly depending nozzle 18, the upper part of which passes with clearance through the bore 21 in an annular boss 20, integrally formed with the portion 54 of the member 16, and surrounding a resilient stopper 22. The nozzle is closed at its lower end and has side ports spaced slightly above the lower end. A thin, flexible, annular membrane 23 is secured to the lower face of the stopper and rests lightly against the stem of the nozzle 18, partly to close off the bore 21.

A pivot 24 carried by the member 16 pivotally supports a manually operable actuating lever 26, having a portion 27 extending through an aperture in a top cover 29, which covers all of the components above the member 16. The lever has a first projection 30 on the forward side of the pivot 24, this engaging a vertically reciprocable rod 32, which in turn engages a release pin (not shown) in the top of the fitting 13 of container 12.

Actuation of the lever 26 presses rod 32 down, which releases carbon dioxide into a chamber 34 in member 16, this gas being fed along a pipe 36 to the interior of the nozzle 18.

Rearwardly of pivot 24 is a second projection 38 which engages a further vertically reciprocable rod 40, which bears on a valve ball 42, normally to hold it away from a 45° frusto-conical valve seat 44 formed integrally on member 16. When the lever is depressed, a spring 46 urges a valve ball 47 against the valve seat. A further flexible tube 48 connects the interior of boss 20 to a connection point above seat 44 via bore 49 shown in phantom in the lefthand part of the member 16.

A shatterproof translucent polycarbonate housing 52 is connected to member 16 and surrounds the nozzle 18. Preferably the shatterproof housing is formed of an inner cylindrical tube (not shown) and an outer portion which is shaped to provide the desired outer design features. This arrangement ensures a very strong construction, while enabling the interior of the shatterproof housing to be seen. The portion 54 of the member 16 is connected to the remainder by a hinge (not shown), enabling housing 52, nozzle 18 and the associated parts 20, 22, 36, 48 to pivot forwardly to the position indicated at 53 in phantom.

Mounted below the open bottom portion of the housing 52, when in its full line, upright position, is a horizontal casing portion 56 arranged above an undercut front portion 58, which has an inclined lead-in surface 60 therebelow. Vertically reciprocable behind front portion 58 is a stem 62, having a flat table 64 at its top and a plug 66 at its bottom. The plug forms a follower for a cam 68 mounted on a shaft 70 which carries a lifting lever 72.

In use, the housing is pivoted out to the position 53 indicated in phantom and a partly filled bottle 80 is inserted, with the pivoted nozzle 18 located just above the cap 82 of the bottle. This is facilitated by the undercut 58 and the lead-in surface 60. The housing, together with the bottle, is pivoted back and the lever 72 is pulled down to the substantially horizontally extending position shown in phantom at 73. This has the effect of pivoting the cam 68 clockwise by approximately 130° which raises shaft 62, table 64 and forces the top of the cap 82 against the stopper 22.

Figure 2:
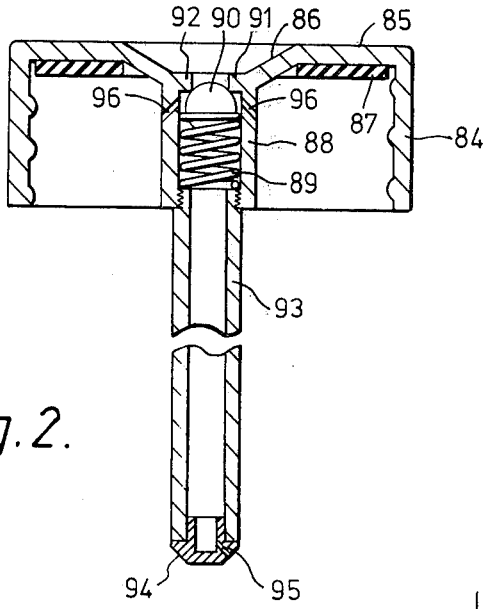
FIG. 2 is an enlarged view of the cap on the bottle of the appliance of FIG. 1.

If reference is now made to FIG. 2, it will be seen that the stopper has a conventional threaded skirt portion 84, and a flat top portion 85 with a central conical recess 86 therein. An annular sealing ring 87 is located below the flat portion 85.

Extending downwardly from the centre of the recess 86 is a valve housing 88 which encloses a valve spring 89 and a valve ball 90, the latter seating against the bottom of an annular flange 91 surrounding an aperture 92.

A dip tube 93 is screwed into the housing 88 and holds the valve spring in position. At its lower end the dip tube 93 is provided with a head 94 having an inclined orifice 95 therein.

When the lever 72 is moved to the position 73, the bottle will be pushed upwardly so that the lower closed end of the nozzle 18 unseats the ball 90 on the annular flange 91. When the lever 26 is depressed, against the action of its return spring 28, the rod 32 is moved downwardly and carbon dioxide flows through pipe 36 into the nozzle 18 and escapes through the ports adjacent the lower end, past the ball 90 and into the dip tube 93. The gas is then projected into the water in the bottle and has a fairly extensive flowpath which gives a good degree of dissolution of the gas in the water.

It will be appreciated that when the pressure rises to a preset value in the bottle, this pressure is sensed via bleed holes 96 in housing 88, these bleed holes being above the ball 90 when the latter is in its lower position. The pressure flexes back the membrane 23, is passed through the bore 21 in the boss 20, into the pipe 48 and the connection of the bore 49 to above the ball 42, to lift the ball off its seat 44, against the action of the spring 46. This ensures that the pressure in the bottle 80 does not become too high and also produces a whistling sound to indicate that the bottle can be removed.

It will be appreciated that the lever extension 38 normally holds the valve 42 open, so that there will be no tendency for this valve to stick.

When the bottle is fully charged, the lever 72 is pivoted back to its near vertical position, which allows the table to drop to the position shown, together with the bottle 80, and this, together with the housing 52, is pivoted to the phantom position 53 once again, and the bottle is removed. With the lever 27 released, the pressure above the membrane is atmospheric, and the flexibility of the membrane is such as to retain a few pounds per square inch within the recess 86. When the table is lowered, this pressure forces the bottle down to remove it from the stopper. The membrane also prevents the ingress of any water into the bore 21. As the lever 73 is returned to the position indicated at 72, and the bottle lowered, the force between the nozzle 18 and the ball 90 is removed, so that the ball retains the pressure within the bottle.

One can either subsequently add any flavouring syrup or, with this construction, it is possible to apply the flavouring syrup together with the water in the first place. The valve ball 90 and the membrane 23 effectively prevent any deleterious frothing up of the contents of the bottle.

The bleed holes 96 can be omitted and the incoming gas pressure can be kept below a preset value by a pressure reducer and/or by an overpressure valve branched off from the nozzle.

Figure 3:
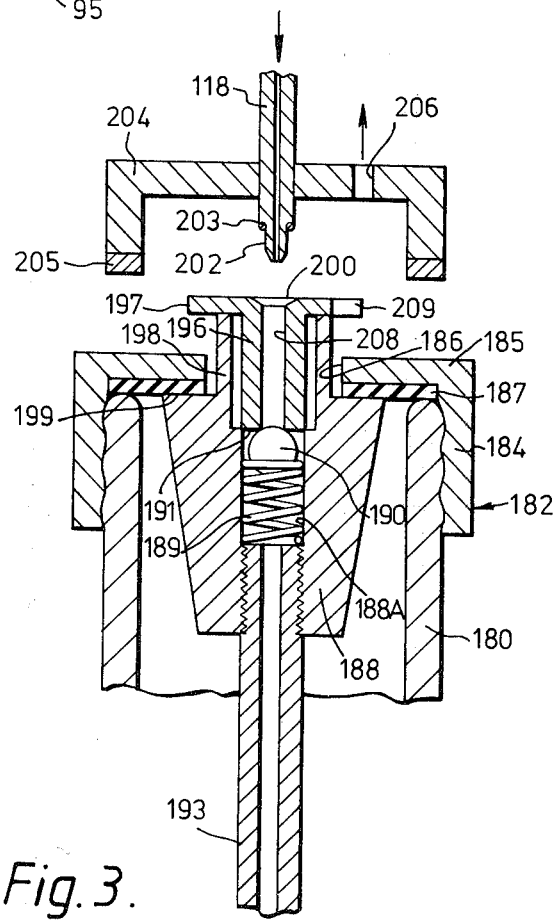
FIG. 3 is a similar view of a second embodiment of cap on the bottle of the appliance of FIG. 1.

The construction illustrated in FIG. 3 has a number of parts similar to that illustrated in FIG. 2 and like parts have been indicated by like reference numerals, with the addition of 100.

The cap is indicated by the general reference numeral 182 and includes an internally threaded screw portion 184 having a flat top portion 185 with a central aperture 186 therein. Mounted below the lower surface of the flat portion 185 is an annular gasket 187 having its aperture aligned with aperture 186.

Mounted for limited axial or vertical reciprocation in the aperture 186 is a piston 188 which has an axial bore 188A therein. Within this bore is mounted a spring 189 and a valve ball 190, which is urged upwardly by the spring against a valve seat 191 formed on the lower surface of an insert 196 which is provided with an annular flange 197 which rests on the upper surface of the rod part 198 of the piston which passes through the aperture 186. The flange 197 and an annular shoulder 199 on the piston itself limit the vertical reciprocation.

Screwed into the lower end of passage 188A is a dip tube 193 similar to the dip tube 93.

Instead of its stopper illustrated in FIG. 1, which is of the conventional type, the stopper in this construction consists of a cup-shaped member 204 with an annular gasket 205 around its rim, the "base" of the inverted cup being provided with an orifice 206 which communicates with the pressure relief valve passage 48, shown in FIG. 1.

In use, water is introduced into the bottle 180 and the cap screwed into place. The bottle is placed in the appliance of FIG. 1, modified with the stopper 204, 205, and when the bottle is forced upwardly, the tip 202 of the nozzle 118 is introduced into the bore 208 of insert 196, a sealing ring 203 engaging the conical surface 200 of the upper surface of the bore 208. The relative positions are then such that the lower surface of the flange 197 is in abutting relation with the upper surface of the flat portion 185 of the cap. It will be noted that a recess 209 is formed in the flange 197 so that communication can then be made between the interior of the bottle, via the clearance between the stem portion 198 and the aperture 196, through the recess 209 into the cup-shaped stopper and thence into the exhaust valve. Thus when the pressure of carbon dioxide in the bottle has reached a preset value, the pressure release valve will release the pressure as is conventional.

When the bottle is removed from the machine, the pressure of carbon dioxide acting on the larger area of the under-surface and side-surfaces of the piston 188, will urge the piston upwardly so that the shoulder 199 immediately seals against the gasket 187. Thus the pressure within the bottle is maintained when the bottle is removed from the appliance.

Thus the piston 188 and its associated parts in effect act as a double valve allowing carbon dioxide to be introduced under pressure, and also allowing it to escape when an overpressure condition occurs.

We claim:

1. An appliance for making an aerated beverage, said appliance comprising a casing, a connection carried by said casing for mounting a container of pressurized liquid carbon dioxide, a bottle to be filled with water, a shatterproof housing for the bottle of water and carried by said casing, a nozzle communicating with said connection and extending downwardly within said housing, means for supporting the bottle in said housing whereby the nozzle can communicate with the interior of the bottle, a manually operable valve allowing carbon dioxide to flow from said container mounted on said connection to said nozzle, and thus into the water in the bottle, a cap on said bottle, including a body securable to the neck of the bottle, a dip tube mounted on said cap body to extend into water contained in said bottle when the cap is secured on the neck, means defining a passage in the cap communicating with the dip tube and with the exterior, enabling carbon dioxide to be introduced under pressure through the dip tube into the water in the bottle, and a non-return valve mounted in the passage to prevent water or gas returning to the exterior via said passage.

2. An appliance as claimed in claim 1, wherein said casing further comprises a stopper engageable with the cap and a safety pressure valve connected to the interior of the bottle when the stopper is engaged with the cap.

3. An appliance as claimed in claim 2, wherein said cap comprises a housing having a valve seat at its upper end, a valve member axially movable in the housing, a spring urging said valve member resiliently against said valve seat, and means defining at least one bleed hole in the housing effective to provide communication between the interior of the housing above the valve member, when it is unseated from the valve seat, and the space above the water in the bottle, whereby the interior of the bottle communicates with said safety pressure valve.

4. An appliance as claimed in claim 2, wherein said cap further comprises a top wall portion, means defining an aperture in said top wall portion, a piston mounted for limited vertical reciprocatory motion in said aperture, a clearance being formed between the piston and aperture walls, means to restrain downward movement of the piston, an upwardly facing shoulder on said piston, a downwardly facing lower surface on the top portion of said cap, whereby the upwardly facing shoulder can engage sealingly on said lower surface, means defining a passage in said piston, a dip tube engaged in said passage, a valve seat at the upper end of said passage, a valve member axially movable in the passage and a spring urging the valve member resiliently against the valve seat, whereby the interior of the bottle communicates with the safety pressure valve.

5. A cap for a bottle to be used in an appliance for making an aerated beverage, said cap comprising a body securable to the neck of a bottle, a dip tube mounted on the cap body effective to extend into water contained in the bottle when the cap is secured on the neck, means defining a passage in the cap communicating with the dip tube and with the exterior, enabling carbon dioxide to be introduced under pressure through the dip tube into the water in the bottle, and a non-return valve mounted in the passage, said valve comprising a housing, a valve seat at the upper end of said housing, a valve member axially movable in the housing, a spring urging the valve member resiliently against the valve seat, and means defining at least one bleed hole in the housing effective to provide communication between the exterior of the housing above the valve member, when it is unseated from the valve seat, and the space above the water in the bottle, whereby said non-return valve prevents water or gas returning to the exterior via said passage.

6. A cap for a bottle to be used in an appliance for making an aerated beverage, said cap comprising a body securable to the neck of a bottle, a dip tube mounted on the cap body effective to extend into water contained in the bottle when the cap is secured on the neck, means defining a passage in the cap communicating with the dip tube and with the exterior, enabling carbon dioxide to be introduced under pressure through the dip tube into the water in the bottle, said cap comprising a top portion thereof, means defining an aperture in said top portion, a piston mounted for limited vertical reciprocatory motion in said aperture, a clearance being formed between the piston and the aperture walls, means to restrain downward movement of the piston, an upwardly facing shoulder on said piston, a downwardly facing lower surface formed on said top portion of the cap and engageable by said upwardly facing shoulder, said means defining a passage being formed in said piston, said dip tube being engaged in said passage, a valve seat at the upper end of said passage, a valve member axially movable in the passage and a spring urging the valve member resiliently against the valve seat to prevent water or gas returning to the exterior via said passage.

* * * * *